US005392702A

United States Patent [19]

Suzuki

[11] Patent Number: 5,392,702

[45] Date of Patent: Feb. 28, 1995

[54] MAGNETIC ROLLING SYSTEM HAVING ROLLERS WITH LAMINATED PLY UNITS DISPOSED THEREIN

[75] Inventor: Hideo Suzuki, Higashikurume, Japan

[73] Assignee: Bellmatic, Ltd., Higashikurume

[21] Appl. No.: 151,723

[22] Filed: Nov. 15, 1993

Related U.S. Application Data

[63] Continuation-in-part of Ser. No. 723,676, Jun. 27, 1991, abandoned, which is a continuation of Ser. No. 476,611, Feb. 7, 1990, abandoned.

[30] Foreign Application Priority Data

Feb. 15, 1989 [JP] Japan ..... 1-35483

[51] Int. Cl.[6] ..... B30B 3/04

[52] U.S. Cl. ..... 100/163 R; 100/168; 100/917; 425/3; 492/8

[58] Field of Search ..... 100/917, 155 R, 160, 100/163 R, 168, 169; 492/8; 425/3, DIG. 33

[56] References Cited

U.S. PATENT DOCUMENTS

| | | | |
|---|---|---|---|
| 3,150,419 | 9/1964 | Aurich | 100/917 X |
| 3,176,608 | 4/1965 | Klara et al. | 100/163 R |
| 3,413,915 | 12/1968 | Goodwin et al. | 100/917 X |
| 3,456,582 | 7/1969 | McClenathan | 100/163 R |
| 3,556,000 | 1/1971 | Goodwin et al. | 100/169 |
| 3,641,928 | 2/1972 | Kraft et al. | 100/160 |
| 3,720,160 | 3/1973 | Kraft et al. | 100/917 X |
| 4,062,097 | 12/1977 | Riihinen | 100/917 X |
| 4,376,330 | 3/1983 | Weidinger et al. | 100/917 X |

FOREIGN PATENT DOCUMENTS

| | | | |
|---|---|---|---|
| 1574294 | 11/1972 | Germany . | |
| 2236247 | 2/1976 | Germany . | |
| 2742661 | 8/1978 | Germany . | |
| 3212834 | 11/1982 | Germany | 492/8 |
| 3404833 | 8/1985 | Germany . | |
| 575567 | 4/1958 | Italy | 425/3 |
| 1557939 | 12/1979 | United Kingdom . | |
| 2143302 | 2/1985 | United Kingdom . | |

*Primary Examiner*—Stephen F. Gerrity
*Attorney, Agent, or Firm*—Cushman, Darby & Cushman

[57] ABSTRACT

A rolling apparatus utilizing magnetic forces established between two main rollers so that a workpiece undergoes a uniform and predetermined pressure throughout the rolling process. At least one of the main rollers has a ply unit preferably made from insulated and laminated silicon steel sheets within it to substantially eliminate undesirable heating and counter-rotational effects resulting from eddy currents generated by the magnetic flux passing through the rollers. Passageways are provided for a fluid medium in the apparatus to forcibly move the heat by circulating the fluid medium.

9 Claims, 10 Drawing Sheets

MAGNETIC ROLLING SYSTEM HAVING ROLLERS WITH LAMINATED PLY UNITS DISPOSED THEREIN

This is a continuation-in-part (CIP) of application No. 07/723,676, filed on Jun. 27, 1991, now abandoned, which is a continuation of 07/476,611, filed on Feb. 7, 1990, now abandoned.

BACKGROUND OF THE INVENTION

1. Field of the Invention

This invention relates to an apparatus for rolling metal foil, cloth, paper, or the like, for calendaring. More particularly, the present invention relates to a rolling apparatus with a magnetic force applied thereto for pressing the workpiece.

2. Description of the Related Art

Referring to FIG. 14, one conventional way of rolling metal foil or cloth for calendaring is explained. Numerals 1, 2 and 3 denote rollers, numerals 5, 6 and 7 denote guide rollers, and numeral 4 denotes a workpiece. The workpiece 4 is guided by the guide rollers 5, 6 and 7 and rolled by the rollers 1, 2 and 3 respectively such that the workpiece 4 is flattened or calendared. Referring to FIG. 15, one conventional way of pressing the workpiece 4 is explained. A hydraulic pump 8 presses a bearing 1*a* which supports the roller 1 such that the workpiece 4 is pressed between rollers 1 and 2. It is also possible to press upwardly on a bearing 2*a* which supports the roller 2 such that the workpiece 4 is pressed in between rollers 1 and 2.

However, when rollers 1, 2 and 3 are made of metal, they tend to deflect as shown in FIG. 15 because of the pressure applied to the bearings 1*a* or 21. So, it is impossible to clamp the workpiece between the rollers with a uniform pressure, resulting in poor performance.

Further, the pressure exerted by the hydraulic pump 8 against the bearings 1*a* or 2*a* cannot always be maintained at a constant value, so the unbalanced pressure causes an unbalanced rolling as shown in FIG. 17. When one of the rollers 1, 2 and 3 is of an elastic material, for instance, plastic or the like, its surface is easily scratched resulting in a degraded workpiece.

Further, since a plastic roller is not heat resistant, when the workpiece is heated during the rolling process, a plastic roller will deteriorate. To avoid the aforementioned disadvantages, some detecting means to detect the scratches in the workpieces is required, as well as frequent replacement of the deteriorated roller resulting in a higher manufacturing cost.

SUMMARY OF THE INVENTION

According to the present invention, a uniform pressure is applied on the workpiece along the axial direction of the rollers when the workpiece is pressed between the rollers, by applying a controllable magnetic force to clamp and press the workpiece resulting in the trouble-free manufacturing and easy maintenance. To attain the above described object, a magnetic force is applied to attract the rollers such that a workpiece clamped and pressed between the rollers undergoes a uniform and predetermined pressure throughout the rolling process.

BRIEF DESCRIPTION OF THE DRAWINGS

The above and other objects, features and advantages of the present invention will become more apparent from the following description of the preferred embodiment thereof taken in conjunction with the accompanying drawings in which like reference numerals denote like members and of which.

DETAILED DESCRIPTION OF THE INVENTION

Referring to the accompanying drawings, the preferred embodiments of the present invention will be described in detail.

Figure 1:
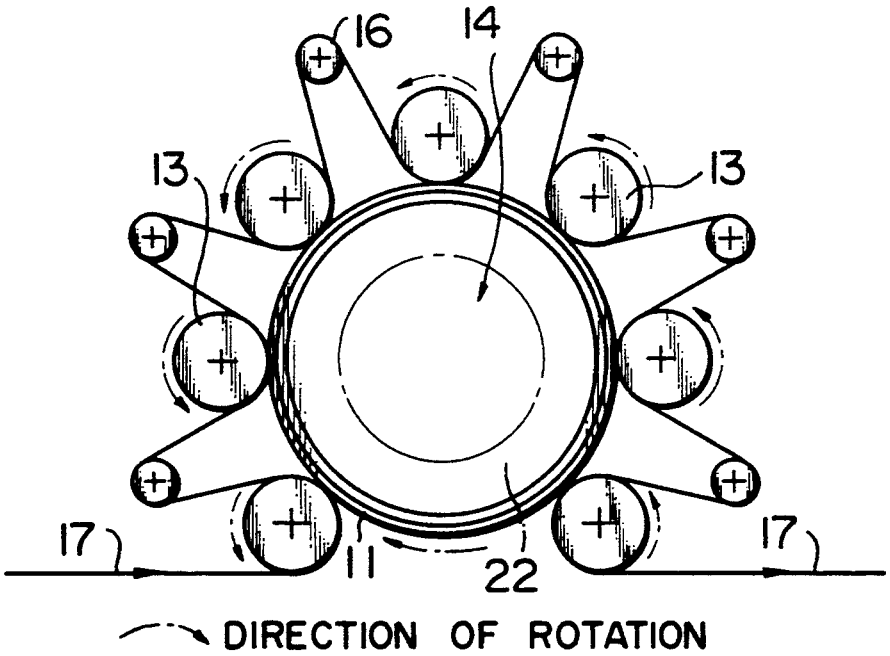
FIG. 1 is a side view of a rolling apparatus according to the first embodiment of the present invention.
Figure 2:
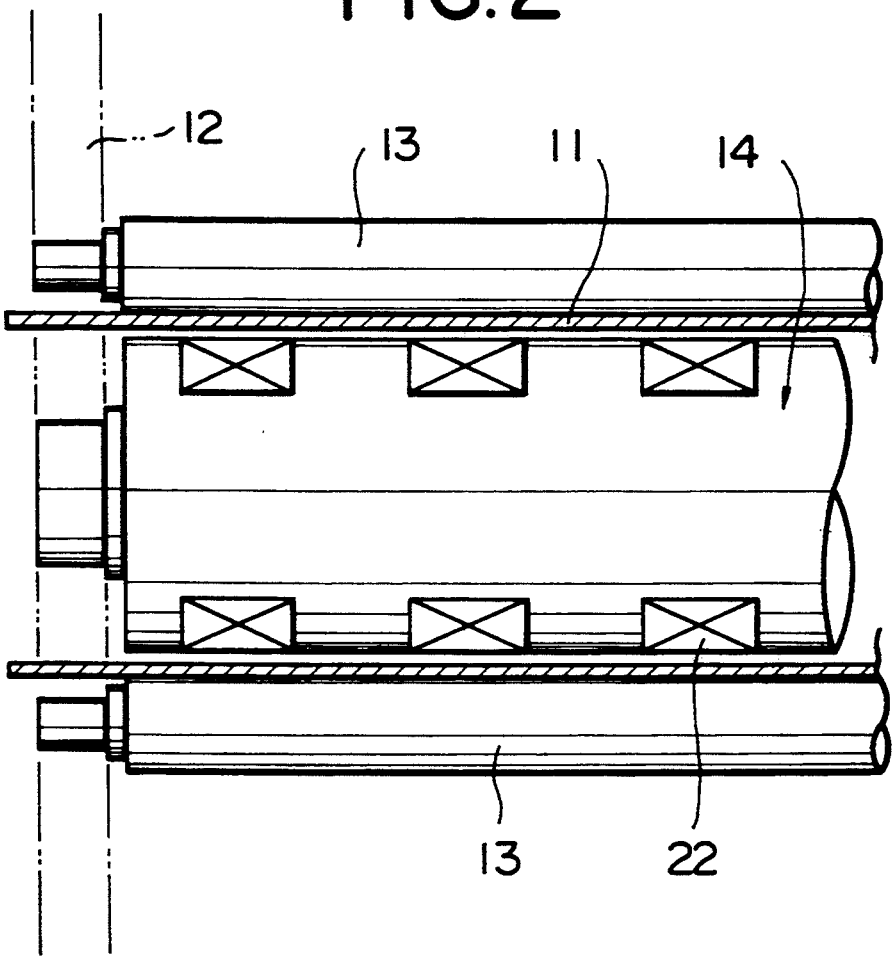
FIG. 2 is a partial section view of the rollers shown in FIG. 1.
Figure 3:
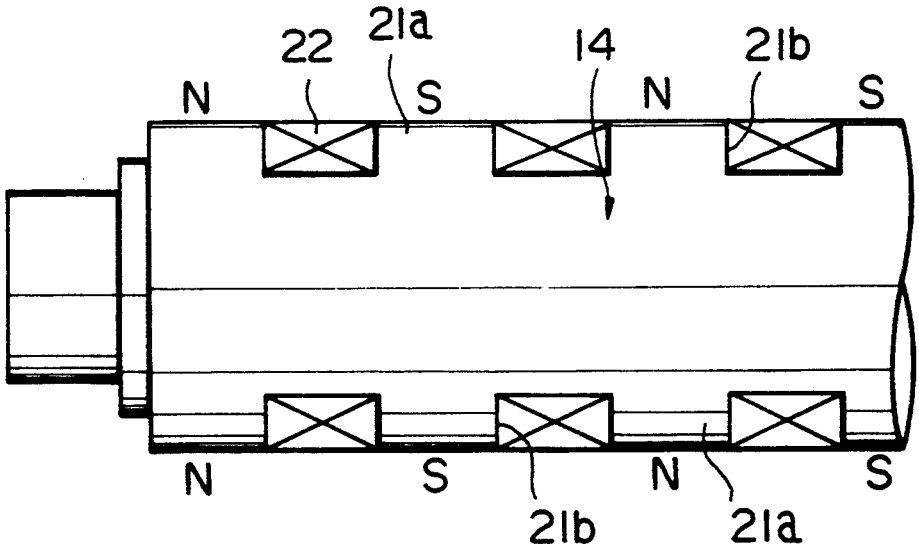
FIG. 3 is a partial section view of a yoke portion in a main roller shown in FIG. 2.
Figure 4:
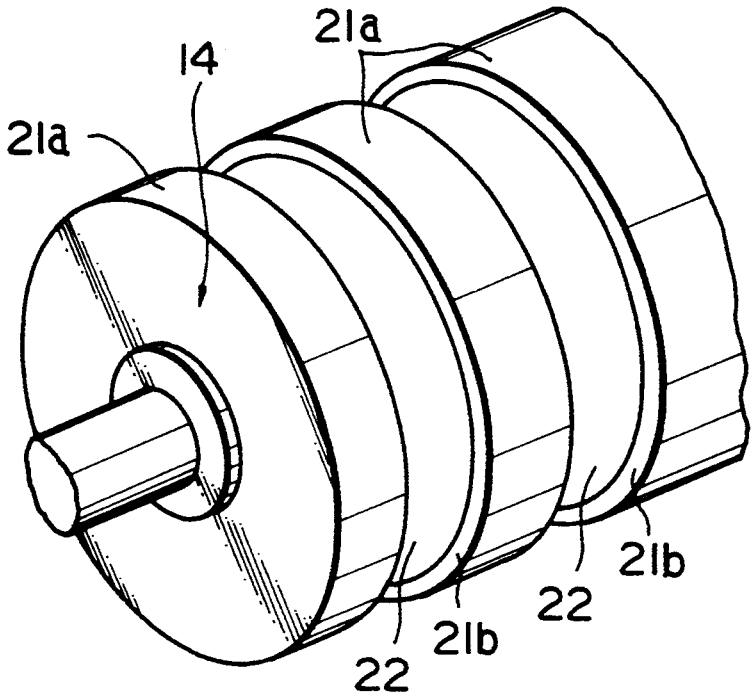
FIG. 4 is a perspective section view of a yoke shown in FIG. 3.
Figure 5:
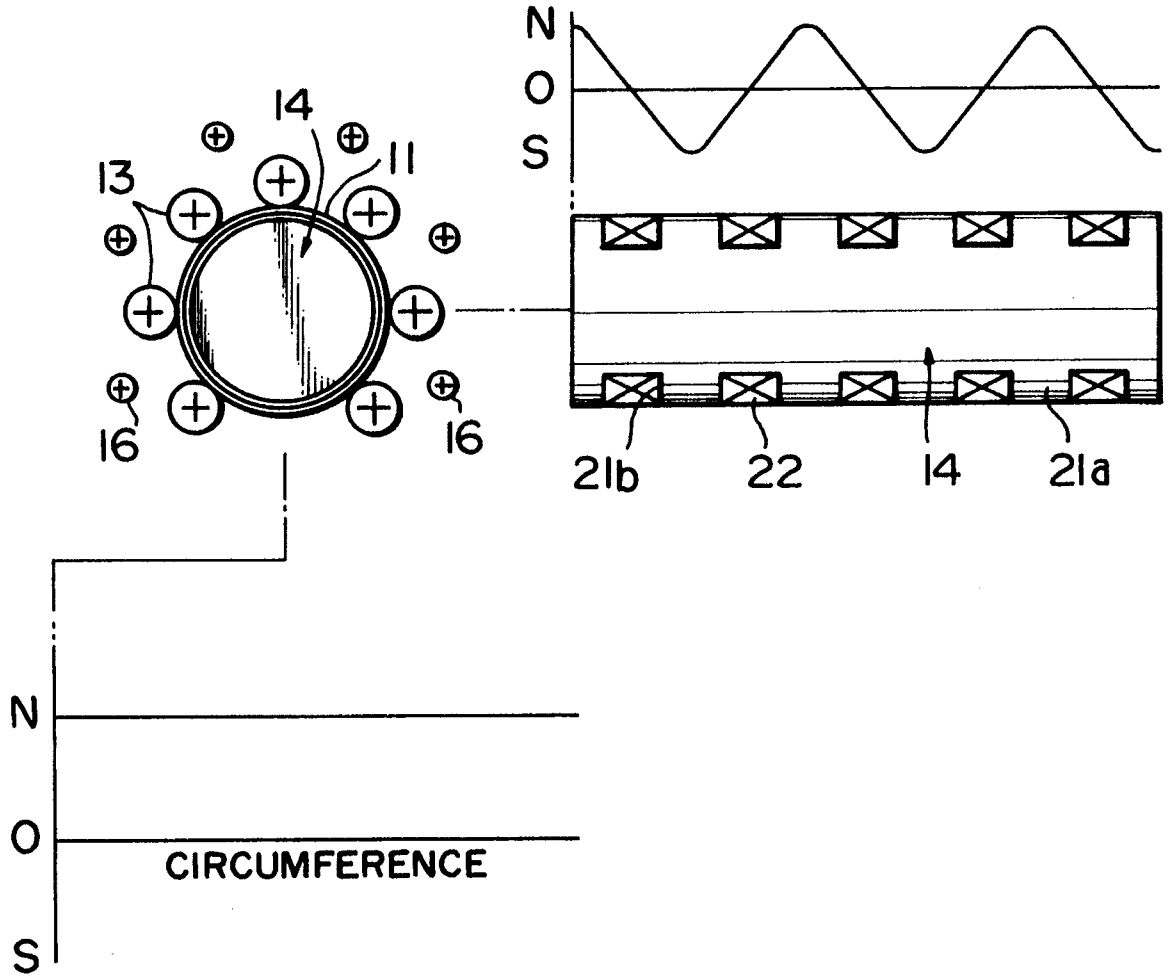
FIG. 5 is an explanatory view showing a magnetic flux line along an axial direction, and around a circumference of a yoke shown in FIG. 3 and FIG. 4.

Referring to FIGS. 1 to 5, the first embodiment of the present invention will be described hereinafter. Numeral 11 (FIG. 2) denotes a main roller which is tubularly shaped and is placed in opposition relation with other pressure rollers and made of non-magnetic materials. The roller rim is preferably thin so that a sufficient magnetic attractive force may be established between the main roller 1 and a pressure roller 13. Although a thin roller rim is preferable, it should be mechanically strong enough to undergo the rolling pressure without excessive deterioration. The main roller 11 is rotatably supported by a frame 12. A suitable number of the pressure rollers 13 which are made of magnetic material are provided around the circumference of the main roller 11. The pressure rollers 13 are rotatably supported by the frame and in pressing relation against the main roller 11. In a hollow portion of the main roller 11, a yoke 14 which consists of magnetic material is inserted and both ends of the yoke 14 are fixed to the frame 12. The yoke 14 is provided with several solenoids 22 which are in opposing relation to the pressure rollers 13. Magnetic flux caused by these solenoids 22 is shown in FIG. 5. A suitable number of guide roller 16 are provided in planetary relation to the main roller 11, and these guide rollers 16 are rotatably supported by the frame 12. Referring to FIG. 1, a workpiece 17 is inserted and passed between the main roller 11 and the pressure roller 13 being guided by the respective guide roller 16. Repeating several equivalent path ways, the workpiece 17 is finally drawn out. The yoke 14 is provided with salient poles 21*a* which establish a magnetic pole and also with grooves 21*h* which accommodate the solenoids 22 shaped annularly with the winding coil accommodated therein. The magnetic flux in the yoke, established by the solenoids 22, is shown in FIG. 5. Along the axial line of yoke 14, N-pole and S-pole are alternately established, and around the circumference of the yoke 14, N-pole or S-pole is established. In this drawing, N-pole is shown. It is also possible to eliminate the guide rollers so that the workpiece 17 is advanced along the circumference of the main roller 11 being inserted and pressed between the main roller 11 and the presser roller 13. When the main roller 11 is rotated by any driving source, the workpiece 17 is rolled and advanced. During the rolling process, the pressure roller 12 is attracted to the main roller 11 because of a magnetic force established by the solenoids 22. The pressure roller 13 is rotated by the fractional between the pressure roller 13 and the workpiece 17.

Thus, the pressing of workpiece between the pressure roller 13 and the main roller 11 is conducted by the magnetic force established by the solenoids 22, and the magnetic force is controlled by regulating the electric direct current to the solenoids.

Figure 6:
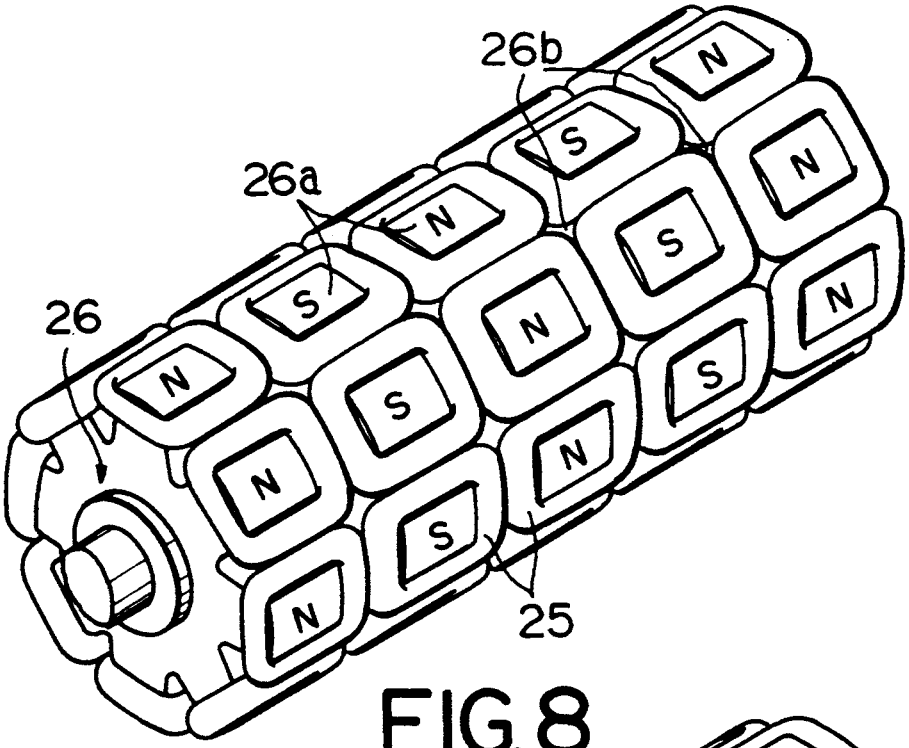
FIG. 6 is a perspective view of a yoke in a main roller according to the second embodiment of the present invention.
Figure 7:
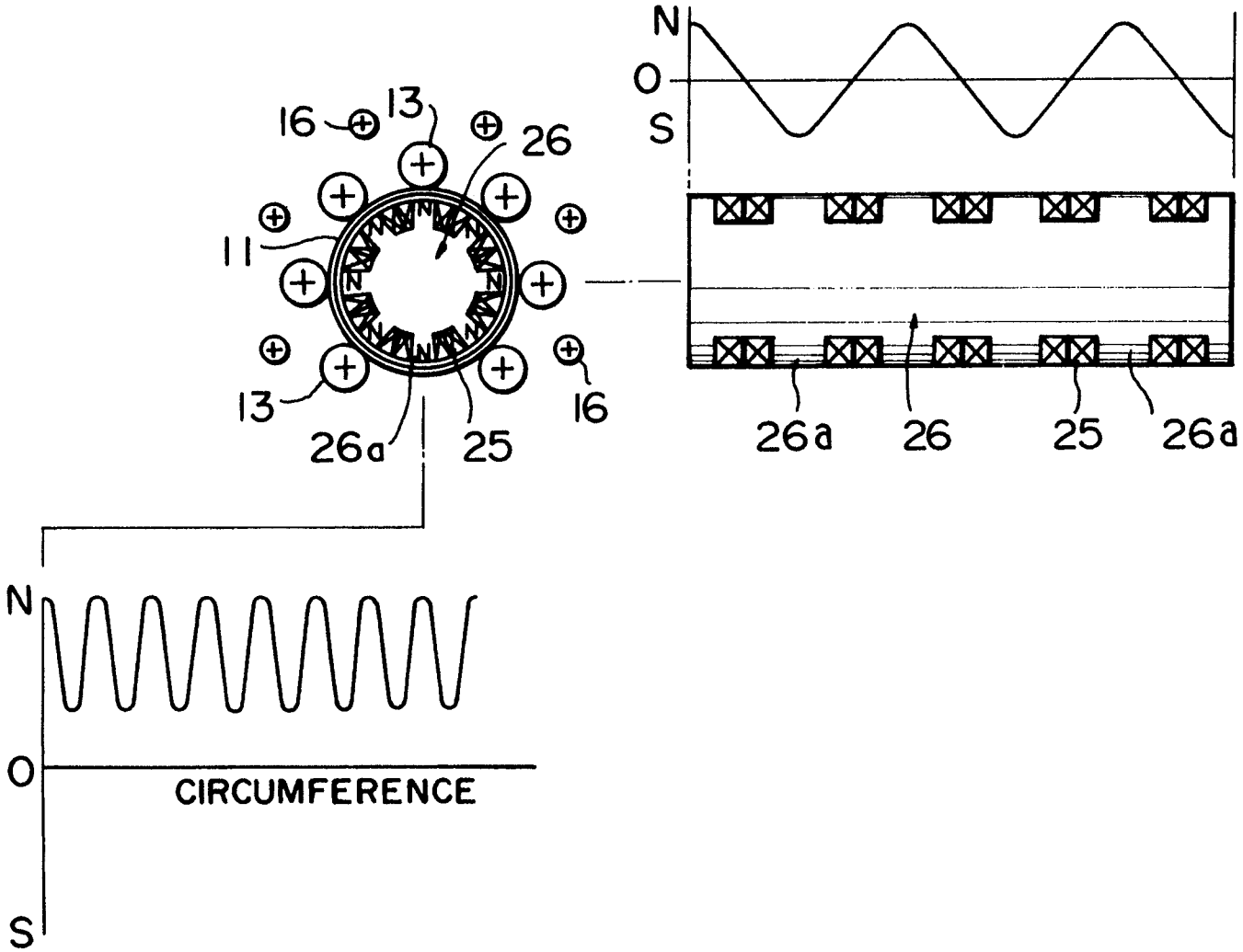
FIG. 7 is an explanatory view showing a magnetic flux along an axial line and around a circumference of the yoke shown in FIG. 6.

Referring to FIG. 6 and FIG. 7 the second embodiment of the present invention will be described. A yoke 26 is provided with solenoids 25 and with salient poles 26*a* which establish the magnetic poles and with grooves 26*b* in which solenoids are accommodated. The magnetic flux in the yoke 26 is shown in FIG. 7. Along the axial line of the yoke 26, N-pole and S-pole are alternately established, and around the circumference of the yoke 26, N-pole or S-pole is established. In this drawing, N-pole is shown.

Figure 8:
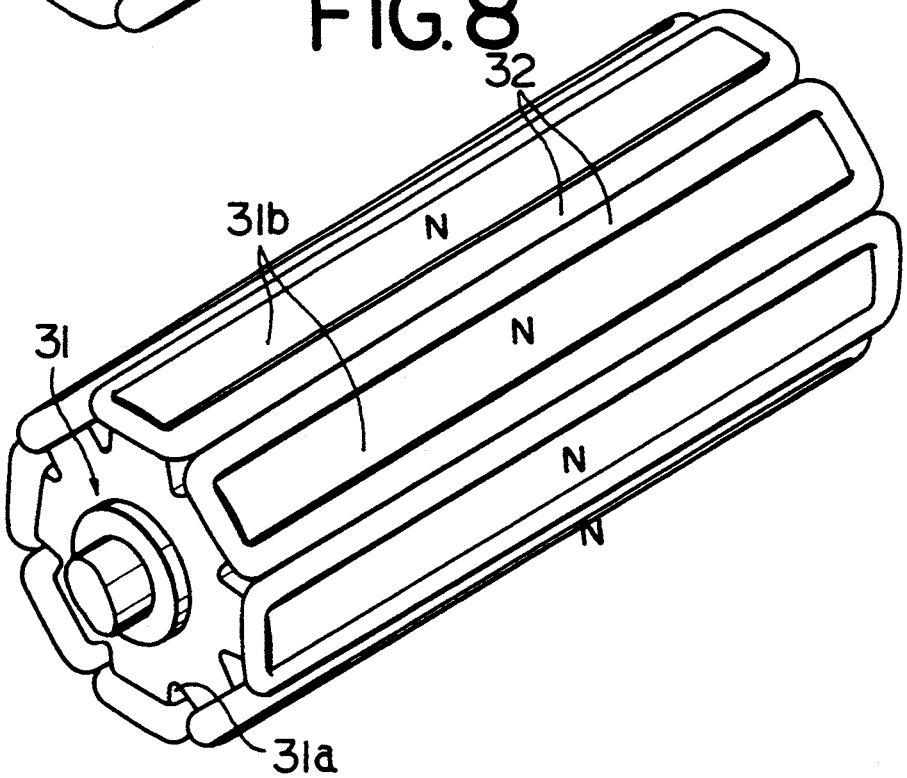
FIG. 8 is a perspective view of a yoke according to the third embodiment of the present invention.
Figure 9:
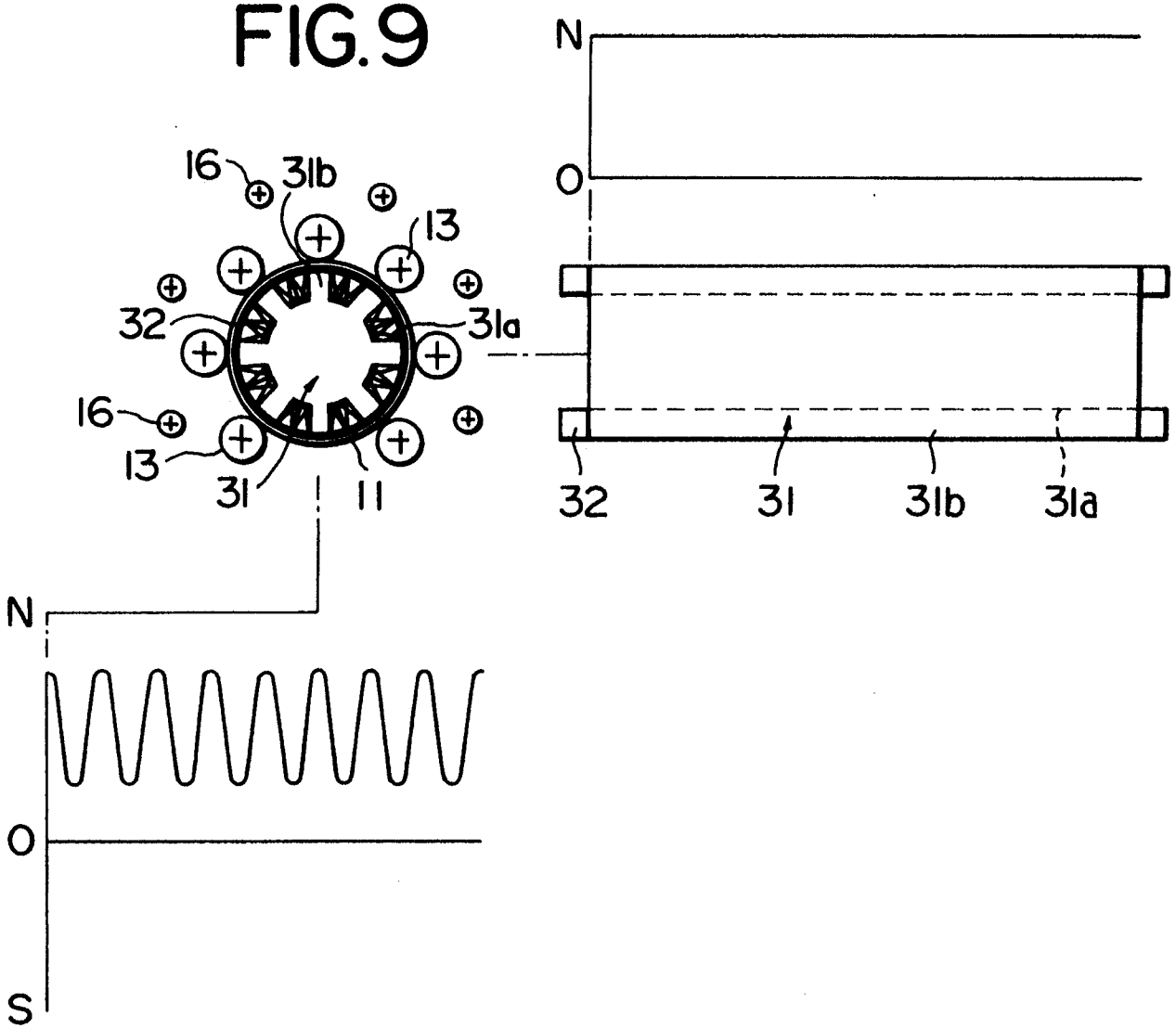
FIG. 9 is an explanatory drawing showing magnetic flux along an axial line and around a circumference of a yoke shown in FIG. 8.

Referring to FIG. 8 and FIG. 9, the third embodiment of the present invention will be described. A yoke 31 is provided with solenoids 32 and salient poles 13*b* established by the solenoids and grooves 31*a* grooved in parallel with the axial line of yoke such that the solenoids 32 are accommodated therein. Under such a construction of the yoke 31, the magnetic flux will be as shown in FIG. 9. Along the axial line of yoke 31, N-pole or S-pole is established. In this drawing FIG. 9, N-pole is shown. Around the circumference of yoke 31, N-pole or S-pole is established. According to the above described three embodiments, the yokes 14, 26 and 31 establish a uniform magnetic attractive force in a direction perpendicular to the axis of a yoke such that the presser roller is attracted to the main roller with a uniform attractive force established along its axial line throughout. The uniform magnetic attractive force can be easily controlled by regulating the electric current to the solenoids. In this manner the pressing due to the pressure roller 12 can be adjusted. Also, the direction of current through the solenoids may be reversed to demagnetize the rollers to release each other, thereby quickly releasing the workpiece. It is also possible to use a permanent magnet in lieu of solenoids 22, 25 and 32.

Figure 10:
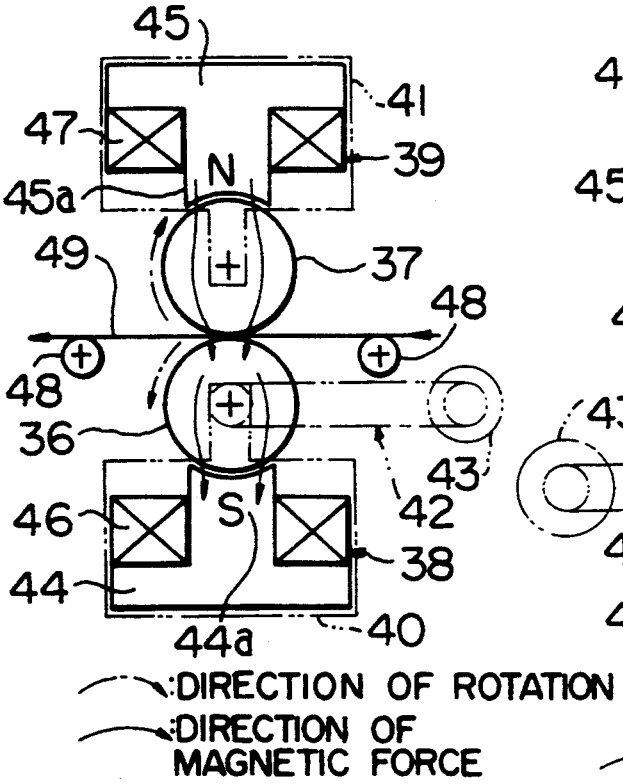
FIG. 10 is a side sectional view of a rolling apparatus according to the fourth embodiment of the present invention.
Figure 18:
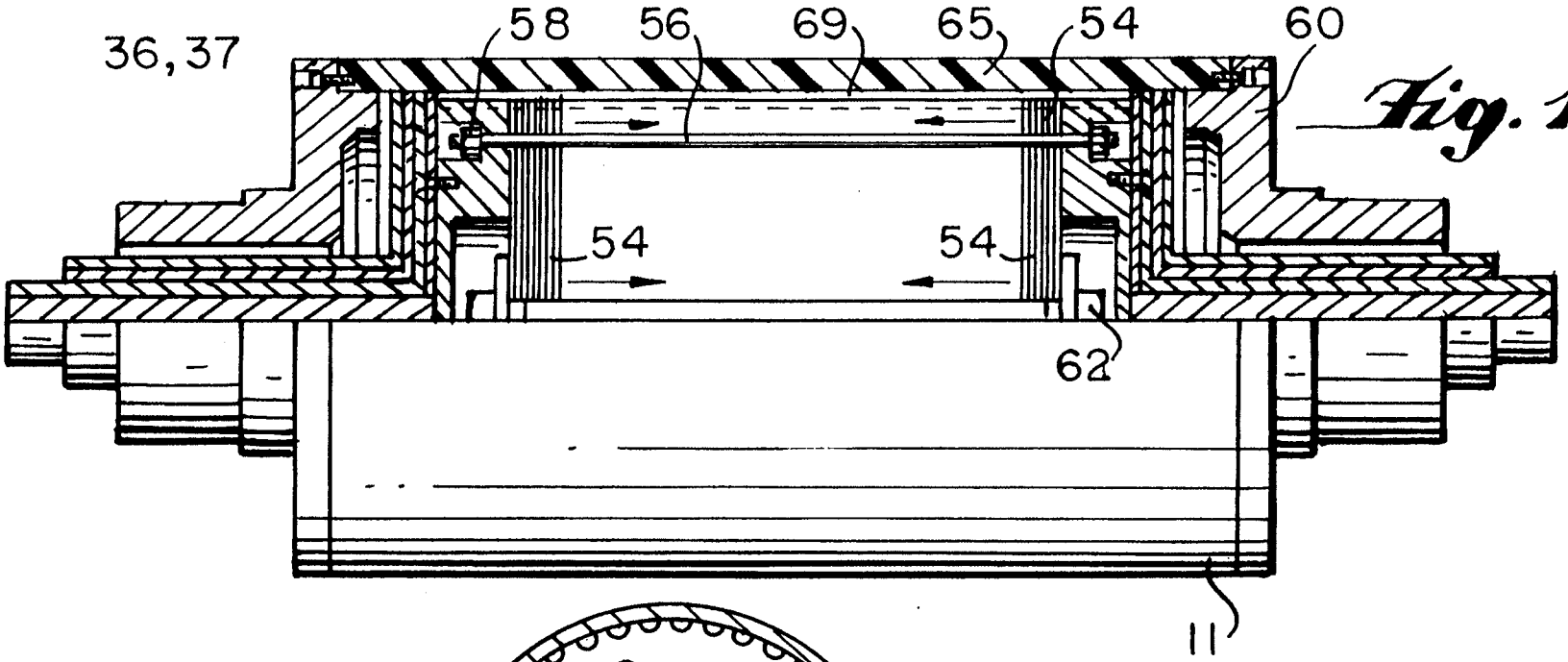
FIG. 18 is a partial cutaway drawing showing the laminated inner structure of a magnetic roller according to the present invention.

Referring to FIG. 10, the fourth embodiment of the present invention will be described. Electromagnets 38, 39 are provided with yokes 44 and 45 having salient poles 44*a* and 45*a* which are fixed to frames 40 and 41. The yokes 44, 45 solenoids 46, 47 respectively wound thereon. Two cylindrical main rollers 36, 37 are supported by the frames 40 and 41 and are placed rotatably in opposing relation and the distance between these two rollers is adjustable. Electromagnets 38 and 39 are disposed such that an attractive force between these two main rollers 36, 37 is established. To establish the attractive force, the main rollers 36, and 37 are made of magnetic material and are adapted to be moved in the direction of the attractive force and rotatably supported by frames 40, and 41 respectively. As shown in FIG. 18, at le0ast one (and preferably both) of the main rollers 36 and 37 has a ply unit 54 made of a magnetic material such as an insulated and laminated silicon steel sheet ply inserted in a hollow portion thereof. Eddy currents, as described on pp. 593–594 of *Physics: For Scientists and Engineers* by Raymond A. Serway (incorporated herein by reference), are produced in entire parts of magnetic rollers, and the eddy currents generate undesirable heat and reverse motion forces on the entire surface of the rotating rollers. Eddy currents are generated on the entire surface of magnetic rollers and result in heat on the surface and in the interior of the rollers. The eddy current generation is proportional to the square of the roller revolution and to the electric conductivity of the roller construction material. As noted above, the eddy currents also generate reverse motion forces opposing the direction of rotation of the roller in accordance with Fleming's law. Consequently, the eddy currents result in harmful effects not only by the heat they generate but also by their reverse motion which forces the rolling apparatus to consume more power to maintain a specified rotational speed. The main rollers having the ply unit of this invention can eliminate such problems.

The present invention is also designed so that when the electromagnet 39 establishes an N-pole at the salient pole 45*a* and the electromagnet 38 establishes an S-pole at the salient pole 44*a*, main rollers 36 and 37 attract each other most effectively. Further, in such a serial alignment of the main rollers fixed to the electromagnets, the entire magnetic flux can go through the two main rollers and therefore the whole magnetic force works to attract the two main rollers together; hence, greater magnetic force can be obtained in this system than in one where the magnetic force is generated by electromagnets conventionally placed in parallel with the rollers. In the latter alignment, the magnetic flux generated by the electromagnets works like a rubber belt and only a portion of the bent magnetic flux above and below the rollers works in a straight line to push the rollers together; but, as indicated above, the force is limited.

Ply unit 54 includes a number of insulated laminate layers 64 (shown in FIG. 19) fixed together by a plurality of alignment rods 56 passing through alignment holes 66 in each of the insulated laminate layers 54. Also, ply unit core 62 runs through the center of the insulated laminar assembly and provides an axis of rotation for the ply unit 54. As seen in FIG. 18, the ends of the ply unit 54 are terminated by ply unit end caps 58 rotatable on axles seated in the frame 12 (not shown). The rollers thus formed similarly have main roller 11 terminated by roller end journals 60.

When used, for example, to soft-calendar a workpiece, the outer shell of at least one of the main rollers is made of non-magnetic materials such as rubber, plastic and cotton.

Figure 19:
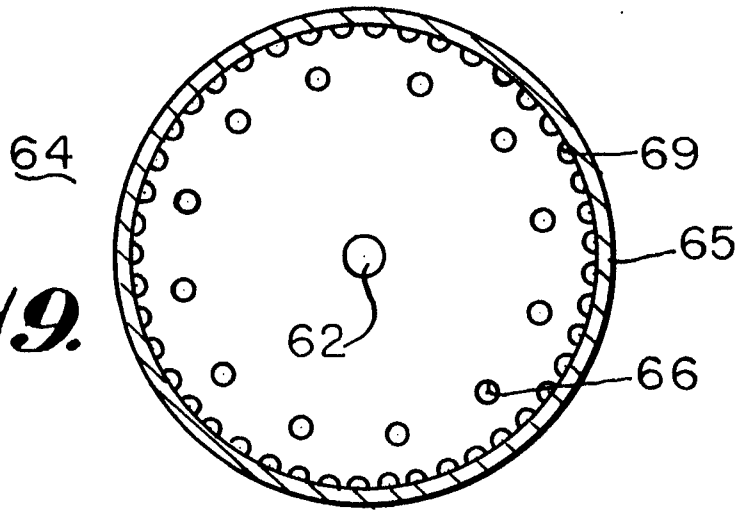
FIG. 19 is a cross-sectional view of the magnetic roller structure of FIG. 18.

If necessary, the main rollers may be heated or cooled as shown in FIGS. 18 and 19 by forcibly circulating a fluid medium such as water, air, oil, hot water or steam through a plurality of passageways 69 provided between the outer shell 65 of the main roller 11 and a plurality of separate peripherally-cut edges of the laminae stacked together in the main roller. In this case, the temperature can be effectively regulated in combination with any outer cooling or heating systems of the fluid medium. One of the main rollers is driven by a belt 42 connected to a drive source 43 such as an electric motor. The electric magnets 38 and 39 are provided with yokes 44, 45 respectively which are fixed to the frames 40, 41. The yokes 44, 45 are provided with solenoids 46, 47 respectively. Solenoids 46 and 47 are disposed on yokes 44 and 45, respectively, for magnetizing its respective yoke by generating a magnetic flux perpendicular to the direction in which the workpiece moves. This flux is along a line running through the centers of the two main rollers. Salient poles 44*a*, 45*a* are placed adjacent to the main rollers 36 and 37 respectively. It is so adapted that when the electromagnet 39 establishes a N-pole, the electromagnet 38 establishes a S-pole so that both main rollers 36 and 37 attract each other. According to the fourth embodiment, when a workpiece 49 is inserted between the main rollers 36 and 37, and solenoids 46 and 47 are energized, the main rollers 36 and 37 approach each other and clamp the workpiece 49. Further, when the drive motor 43 energizes, the main roller 36 rotates and the workpiece 49 is advanced by the fractional force established between the workpiece and the main roller. Thus the workpiece is rolled and the pressing force by these main rollers is controlled by regulating the electric current to the solenoids 46 and 47. Also, as noted above, the polarity of the current can be reversed to cause the rollers to demagnetize each other and quickly release the workpiece.

Figure 11:
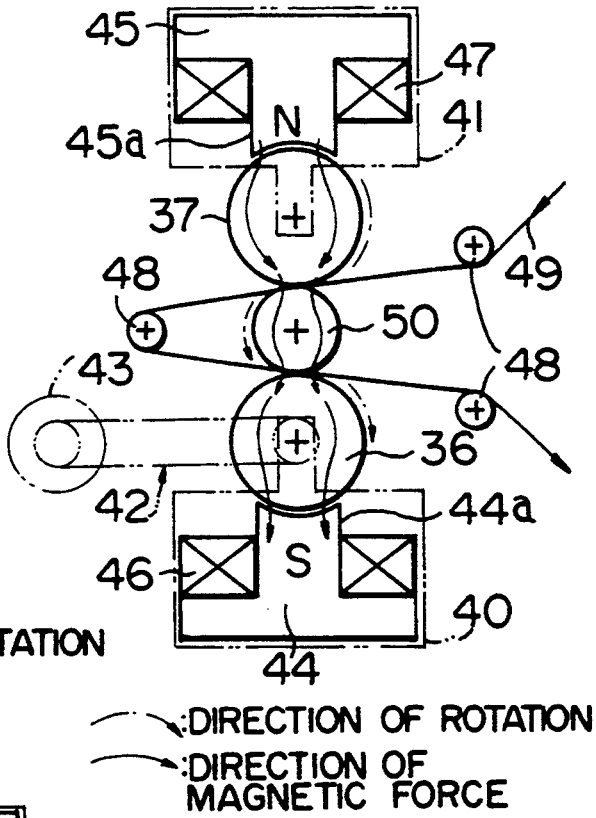
FIG. 11 is a side section view of a rolling apparatus according to the fifth embodiment of the present invention.

Referring to FIG. 11, the fifth embodiment of the present invention will be explained. A middle roller 50 is placed between main rollers 36 and 37. The middle roller 50 is made of a magnetic material, and is attracted to, in contacting relation with, both main rollers 36, 37 when solenoids 46, 47 are energized. When the main rollers 36 is rotated by a belt 42 driven by a motor 43, a workpiece 49 clamped between the middle roller 50 and the main rollers 36 and 37 is advanced by the fractional force established between the middle roller 50 and the main rollers 36 and 37. According to the fifth embodiment, several guide rollers 48 are placed such that the workpiece 49 is guided between the middle roller and the main roller. When solenoids 46 and 47 are energized, the main roller 36 and 37 tend to approach each other, and the workpiece 49 is pressed between the main roller and the middle roller. Further, when the main roller 36 rotates being driven by a belt 42 connected to a motor 43, the workpiece is advanced by the frictional force established between the main roller and the middle roller. The pressing force against the workpiece can be controlled by regulating the electric current to the solenoids 46 and 47. As noted above, the polarity of the current can be reversed to cause the rollers to demagnetize each other and quickly release the workpiece.

Figure 12:
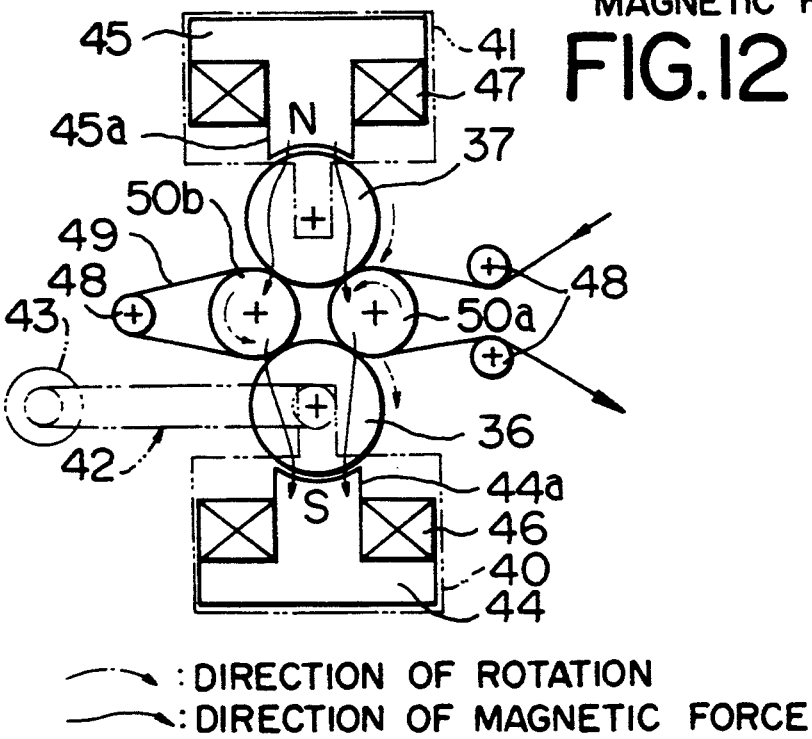
FIG. 12 is a side sectional view of a rolling apparatus according to the sixth embodiment of the present invention.

Referring to FIG. 12 the sixth embodiment of the present invention will be described. Two middle rollers 50*a*, 50*b* made of a magnetic material are placed between main rollers 36, and 37. The construction of the sixth embodiment is very similar to that of the fifth embodiment. A workpiece 49 is inserted between the middle roller 50*a* and a main roller 37 and is drawn out and finally inserted between the middle roller 50*a* and a main roller 36. When solenoids 46, and 47 energize, an attractive force is established between the main rollers 36, and 37 and between the middle roller 50*a*, 50*b*. When the main roller 36 is rotated by a belt connected to a motor 43, the workpiece 49 is advanced by the friction force established between the workpiece and the main roller. The pressing force against the workpiece can be controlled by regulating the electric current to the solenoids 46, and 47. As noted above, the polarity of the current can be reversed to cause the rollers to demagnetize each other and quickly release the workpiece.

Figure 13:
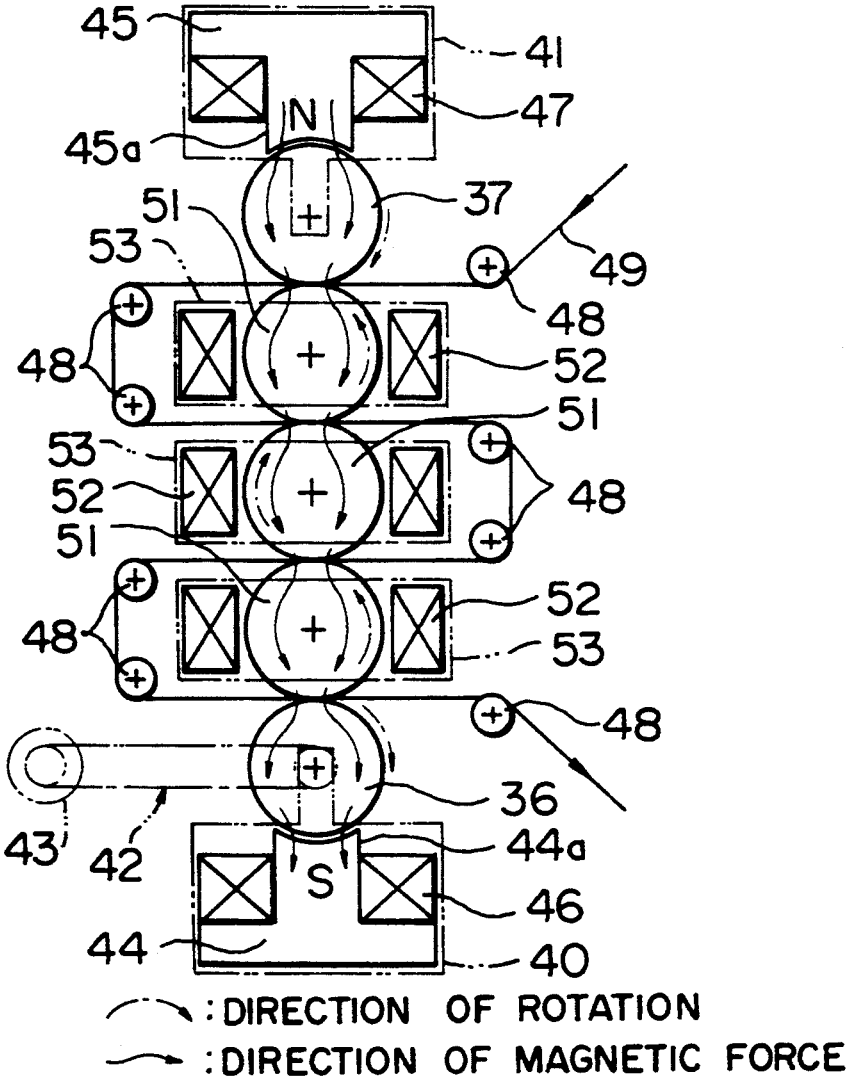
FIG. 13 is a side view of a rolling apparatus according to the seventh embodiment of the present invention.
Figure 14:
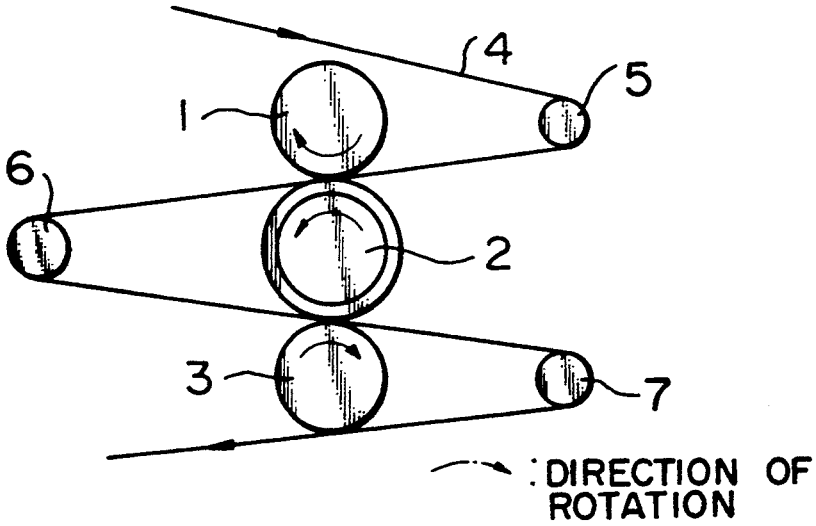
FIG.14 PRIOR ART
FIG. 14 is a side sectional view of a conventional rolling apparatus.
Figure 15:
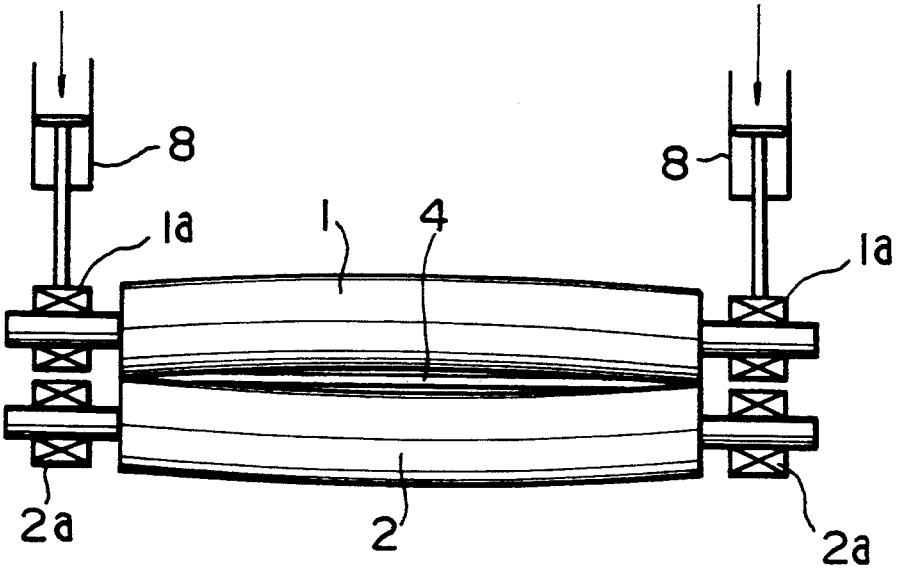
FIG.15 PRIOR ART
FIG. 15, FIG. 16, FIG. 17 are explanatory drawings showing inconveniences of operation associated with a conventional rolling apparatus.
Figure 16:
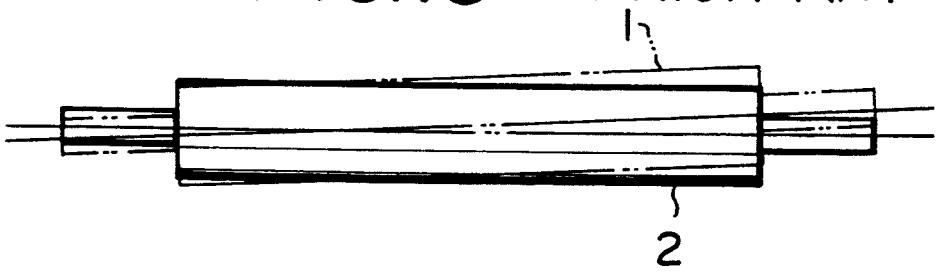
FIG.16 PRIOR ART
Figure 17:
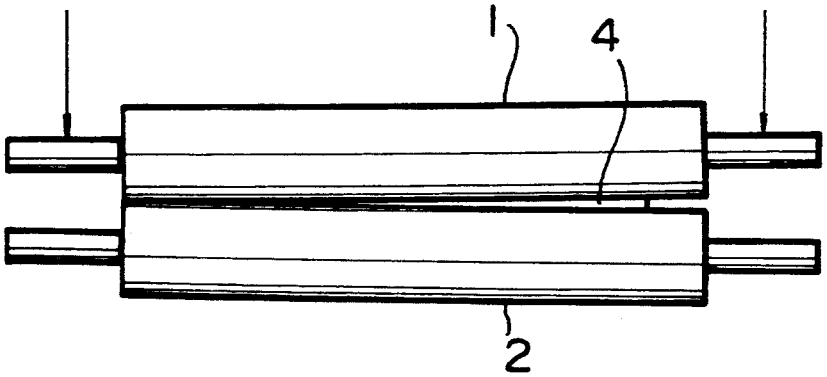
FIG.17 PRIOR ART

Referring to FIG. 13, the seventh embodiment of the present invention will be described. One object of the seventh embodiment is to increase the quantity of rolling steps. Several auxiliary rollers 51 are disposed between main rollers 36, and 37. The auxiliary rollers 51 are made of magnetic material. Increasing the quantity of auxiliary rollers 51 cause the magnetic force established between solenoids 46, and 47 to be weakened. To strengthen the weakened magnetic force, auxiliary solenoids 52 are placed proximate the auxiliary rollers 51. The auxiliary rollers 51 are rotatably supported by frames 53 and are adapted to be moved vertically. The frames 53 are disposed between the main rollers 36, and 37, and are replaceable. By providing yokes on the frames 53 or substituting the frame for the yoke, the auxiliary solenoids 52 can be eliminated. It is also possible to establish the necessary magnetic force auxiliary solenoids 52. The direction of magnetic force established by the auxiliary rollers 51 is in accordance with the direction of magnetic force established by the solenoids 52. According to the seventh embodiment, as shown in FIG. 13, several guide rollers 48 are located at suitable positions, and a workpiece 49 is inserted between the main roller 37 and the auxiliary roller 51, and further between the main roller 36 and the auxiliary roller 51 being rolled and guided steppingly. When the solenoids 46, and 47 and the auxiliary solenoids 52 are energized, the attractive force between the main rollers 36, and 37 and between the auxiliary rollers 51 are established. When the main roller 36 is rotated by a belt 42 connected to a drive motor 43, the workpiece 49 is rolled by the main rollers and auxiliary rollers, guided by guide rollers. The workpiece 49 is advanced by the frictional force established between the workpiece and the opposing roller. In this embodiment, the solenoids 46, and 47 and the auxiliary solenoids 52 are used but these solenoids can be replaced by permanent magnets. According to the aforementioned embodiments, the presser rollers undergo the forced drive.

As aforementioned, according the present invention of a rolling apparatus applying a magnetic force between the main roller and the presser roller, uniform pressure can be applied perpendicularly on the workpiece clamped between the main roller and the pressure roller and the pressure can be freely controlled by regulating the electric current to the solenoid. As noted above, the polarity of the current can be reversed to cause the rollers to demagnetize each other and quickly release the workpiece.

Further, where both the main roller and the pressure roller are made of metals, the workpiece is pressed between the main roller and the presser roller by the magnetic attractive force established therebetween, and the problem of shorter roller life is eliminated although the pressing force is considerably strong, and the frequency of exchanging rollers becomes less because the rollers are made of hard metals.

As many apparently widely different embodiments of this invention may be made without departing from the spirit and scope thereof, it is to be understood that the invention is not limited to the specific embodiments thereof except as defined in the appended claims.

What is claimed is:

1. A rolling apparatus comprising:

a frame;

two cylindrical main rollers, an outer shell of at least one of said main rollers being made of magnetic material being adjacently and rotatably mounted to said frame, at least one of said main rollers being movably mounted to said frame so as to allow adjustment of the distance between said two main rollers, said two main rollers further being disposed to facilitate movement of a workpiece therebetween;

at least one ply unit disposed within at least one of said cylindrical main rollers and rotatably mounted on said frame by a support axis;

two electromagnets, each being disposed opposite alternate ones of said two main rollers and said two main rollers being disposed between said two electromagnets, each one of said two electromagnets having a yoke with a coil wound thereon forming a solenoid for magnetizing the respective one of said two yokes by generating magnetic flux perpendicular to the moving direction of the workpiece and along a line through the centers of said two main rollers, one of said two yokes being magnetized as a salient north pole and the other of said two yokes being magnetized as a salient south pole, each of said salient poles being opposite the main roller containing said ply unit;

means for applying electrical current to each one of said two electromagnets in a first direction to magnetize said two main rollers by the magnetic flux generated by said solenoids so as to attract each other, thereby pressing the workpiece between said two main rollers, and for applying electrical current to each one of said two electromagnets in a second direction to magnetize said two main rollers by the magnetic flux generated by said solenoids so as to demagnetize each other, thereby quickly releasing the workpiece from between said two main rollers; and an electric motor for driving at least one of said magnetic rollers.

2. A rolling apparatus as described in claim 1, further comprising:

a middle roller rotatably attached to said frame and being disposed adjacent to each of said two main rollers; and a plurality of guide rollers rotatably attached to said frame at positions remote from said middle roller;

the workpiece being guided by said guide rollers between one of said two main rollers and said middle roller and then subsequently guided by said guide rollers between the other of said two main rollers and said middle roller.

3. A rolling apparatus as described in claim 1, further comprising:

two middle rollers made of magnetic material rotatably attached to said frame and being disposed adjacent to each of said two main rollers;

a plurality of guide rollers rotatably attached to said frame at locations remote from said middle rollers;

the workpiece being guided by said guide rollers between one of said two main rollers and said two middle rollers and subsequently being guided by said guide rollers between the other of said two main rollers and said two middle rollers.

4. The rolling apparatus of claim 1, wherein said ply unit comprises a plurality of insulated laminae.

5. The rolling apparatus of claim 4, wherein said insulated laminae are silicon steel sheets.

6. The rolling apparatus of claim 4, wherein said at least one ply unit comprises:

a plurality of separate peripherally-cut edges on each of said insulated laminae, each of said separate edges defining a passageway between the ply unit and the outer shell of the main roller, and a plurality of alignment holes in the interior of each of said insulated laminae;

wherein said insulated laminae are stacked together and an alignment rod passes through a corresponding alignment hole in each of said laminae to fix the laminae in position relative to one another.

7. The rolling apparatus of claim 6, wherein a fluid medium is circulated through said passageways provided between said outer shell of at least one of the main rollers and said separate peripherally-cut edges on each of said laminae.

8. The rolling apparatus of claim 1, wherein an outer shell of at least one of said main rollers is made of a non-magnetic material.

9. The rolling apparatus of claim 1, wherein a ply unit is disposed within each of said main rollers.

* * * * *